United States Patent [19]

Eastman

[11] 4,256,017

[45] Mar. 17, 1981

[54] DIFFERENTIAL AREA ELECTROHYDRAULIC DOSER ACTUATOR

[75] Inventor: James M. Eastman, South Bend, Ind.

[73] Assignee: The Bendix Corporation, South Bend, Ind.

[21] Appl. No.: 27,343

[22] Filed: Apr. 5, 1979

[51] Int. Cl.[3] ..... F15B 15/17

[52] U.S. Cl. ..... 91/417 R; 137/596.17

[58] Field of Search ..... 91/417 R, 417 A, 235, 91/321, 47, 3, 20, 31, 361; 137/625.6, 596.17; 318/561

[56] References Cited

U.S. PATENT DOCUMENTS

| | | | |
|---|---|---|---|
| 2,625,136 | 1/1953 | Moog | 91/417 R X |
| 2,650,609 | 9/1953 | Herbst | 91/417 R X |
| 2,999,482 | 9/1961 | Bower | 91/31 |
| 3,279,323 | 10/1966 | Asche | 91/20 |
| 3,382,769 | 5/1968 | Raider | 91/417 R X |
| 3,618,469 | 11/1971 | Wills | 91/361 |
| 3,763,744 | 10/1973 | Fournell | 91/20 |
| 4,007,361 | 2/1977 | Martin | 318/561 |

OTHER PUBLICATIONS

United Technologies Corporation Publication *NAS CR 135135 PWA-5471,* Dec. 1976, by D. M. Newirth and E. W. Koenig, "Analysis and Design of Digital Output Interface Devices for Gas Turbine Electronic Controls."

Air Equipment Report entitled "Design and Development of a Digital Input Flight Servocontrol," 10/2/77.

*Primary Examiner*—Edward J. McCarthy

*Attorney, Agent, or Firm*—Robert C. Smith; Leo H. McCormick, Jr.

[57] ABSTRACT

A doser type hydraulic actuator includes a pair of unequal area pistons on a common shaft which are moved incrementally by injecting into or removing from a control pressure chamber metered quantities or doses of fluid. Doses are metered by timed openings of solenoid valves connecting the control pressure chamber to supply or return pressure sources. Special valve means are provided for moving the actuator piston to a preferred position in the event of control system failure, and means are included for administering very small doses consistently without recourse to special extra fast response solenoid valves.

19 Claims, 12 Drawing Figures

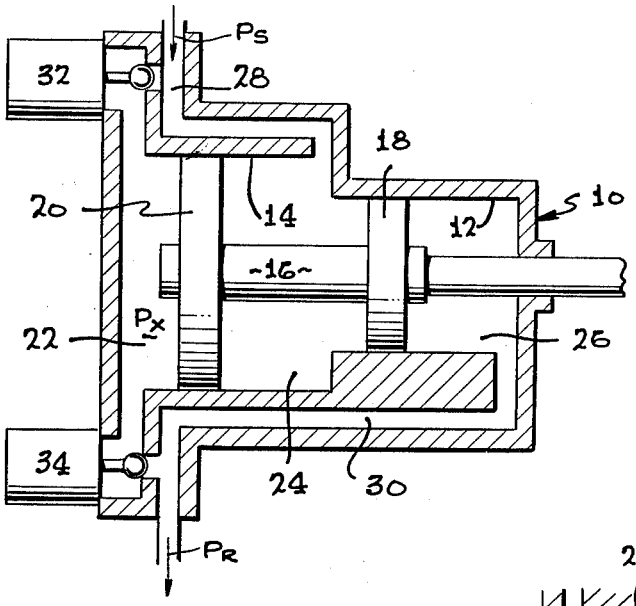
FIG. 1
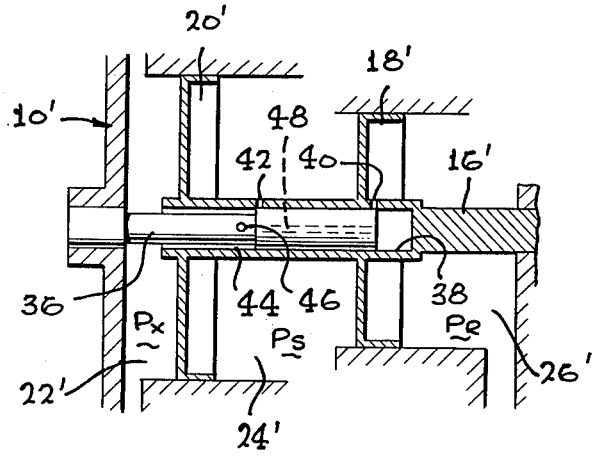
FIG. 2
FIG. 3
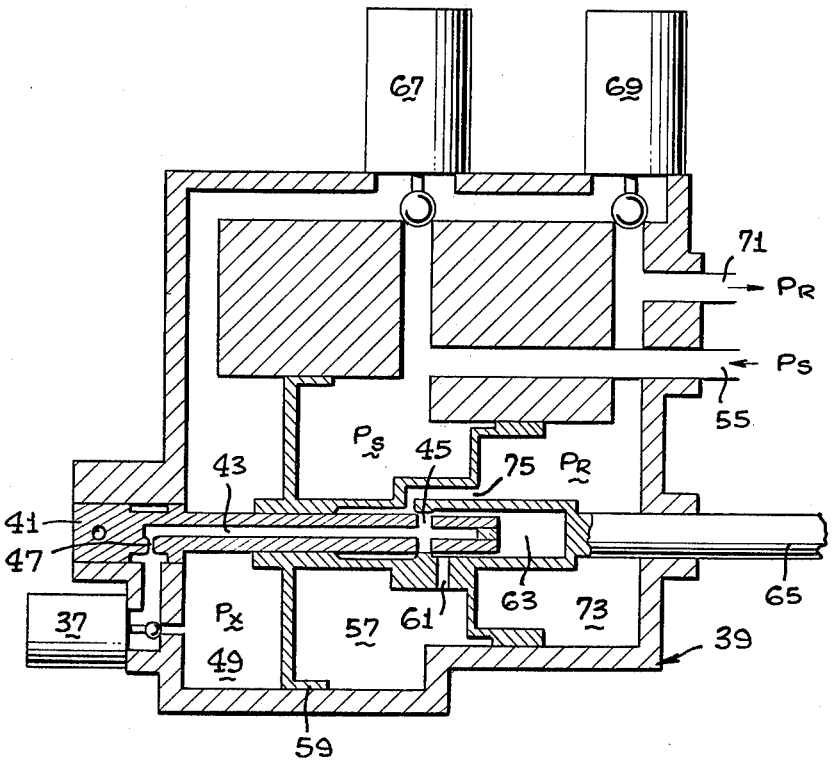

DIFFERENTIAL AREA ELECTROHYDRAULIC DOSER ACTUATOR

BACKGROUND OF THE INVENTION

The concept of a "doser" type of hydraulic actuator has been known in the art for several years. If a measured quantity or "dose" of hydraulic fluid is injected or exhausted from the control chamber of a differential area piston actuator, its output makes a step movement commensurate with the size of the dose. The doses can be administered periodically to achieve a stepping motor type response for digitally administered doses. The dose is controlled by opening a solenoid valve for a discrete time period in response to an electrical pulse from a digital electronic controller. The effective output travel rate of the doser actuator can be varied by varying the pulse frequency and/or the pulse width with the maximum slew rate limited by the flow capacity of the solenoid valve when held continuously open.

Unlike conventional stepper motors, doser actuators do not have inherent digital precision. This is so because, instead of dividing up the stroke of the actuator into precise small fractions for the steps, each step is independently metered so that error is cumulative, and there can be no precise correlation between the number of steps and output positions. Since for most gas turbine control applications geometry is controlled in a closed-loop fashion, the available precision of a true stepping motor exceeds the need, and doser type actuators can serve quite well.

The equilibrium condition for closed-loop operation of a doser or stepper actuator requires either a sensing dead band (for which no position correction is made until the error exceeds the effect of one minimum dose or step) or steady-state limit cycling (where the actuator takes a step, passes the desired position, then steps backward by it, steps forward again, etc.). For either equilibrium condition, precision depends on having a small enough minimum dose or step. Smaller steps require shorter doser solenoid "on" periods and faster stepping motor rates.

While it is true that the size of the dose can be made smaller with progressively shorter energization periods, it is equally true that as the dose is reduced not only does its magnitude become more sensitive to second order effects, but whether it is effected at all becomes more uncertain. For precise actuation, it is highly desirable that a doser actuator be able to administer relatively precise small doses. One way of doing this is by the use of solenoid valves designed for extra fast action and electronic driving circuitry designed to "spike" the solenoid current to help achieve this fast action. Fast solenoid valves and their electronic drive requirements carry penalties in size, weight, electric power and cost.

SUMMARY OF THE INVENTION

The basic doser actuator employed in applicant's concept uses a differential area piston which is controlled by a normally closed solenoid valve for each direction. The piston areas are adjusted so that at equilibrium the control pressure $P_x$ is intermediate between supply pressure $P_s$ and return pressure $P_r$. Opening of a solenoid valve adjacent the supply pressure $P_s$ meters fluid flow into the piston chamber, causing the piston to move in a first direction and to stop when the valve closes. Similarly, opening of the solenoid valve adjacent the return pressure line $P_r$ meters fluid flow out of the control piston chamber $P_x$, causing the piston to move in the opposite direction and to stop again when the valve closes. The smallest discrete movements will occur for the shortest effective actuation period for the solenoid valve. The arrangement described above incorporates a hydraulic locking feature which may be considered desirable in that, in the event of hydraulic or electrical power failure, neither of the solenoid valves will be actuated and the actuator is retained in its position.

For some applications it is preferred that the actuator slowly drift to a preselected position in the event of an electrical failure. In some embodiments described herein, a pair of telescoping pistons are arranged with respect to the various fluid pressure chambers referred to above such that orifices through the side walls of the outside of one of said pistons communicate with a passageway running axially through the center of the other of said pistons such that if the control pistons are moved to the left of the desired position, high fluid pressure is bled through one of said orifices to the control pressure chamber $P_x$, causing the piston exposed to $P_x$ to move toward the right and in a direction to close off the orifice. Similarly, should the control piston be moved to the right of the desired piston, a second orifice is uncovered, permitting control pressure $P_x$ to flow through the passageway in the interior of the inside piston and out of this second orifice to return pressure $P_r$, thereby reducing control pressure $P_x$ and permitting the supply pressure $P_s$ to force the pistons back to the desired position again, in which position both orifices are effectively blocked.

For precise actuation, it is desirable that a doser actuator be able to administer relatively precise small doses. One way of accomplishing this is through the use of additional solenoid valves to provide alternate flow rates to the actuator, with small flow area for minimum doses and high flow areas for fast slewing. Another embodiment of my invention shows such a plurality of solenoid valves with a large and a small area orifice located at each position of the solenoid valves described above. A further embodiment makes use of an elongated restricted flow path to impose a lag in the control fluid response to an electrical input signal. In this way the minimum dose or quantity of fluid injected or removed as a result of the minimum voltage pulse which will assure actuation of the solenoid valve will be somewhat less than in the embodiment where no such restricted passageway is included, and this makes possible smaller flows to the control pressure chamber and smaller increments of movement of the pistons and output shaft. By using a high length to diameter ratio, the restricted passageway impedes flow primarily because of inertial effect for short valve opening time intervals with much less effect on the flow (and piston speed) when the valve is continuously open. A similar effect could be obtained by adding mass to the piston, but at the cost of adversely affecting the weight of the control system.

DESCRIPTION OF THE DRAWINGS

FIG. 1 is a schematic drawing showing a simplified form of doser actuator according to my invention.

FIG. 2 is a schematic drawing of an additional embodiment of my invention.

FIG. 3 is a schematic drawing of a modification of the embodiment of FIG. 2.

DESCRIPTION OF THE PREFERRED EMBODIMENTS

Figure 4:
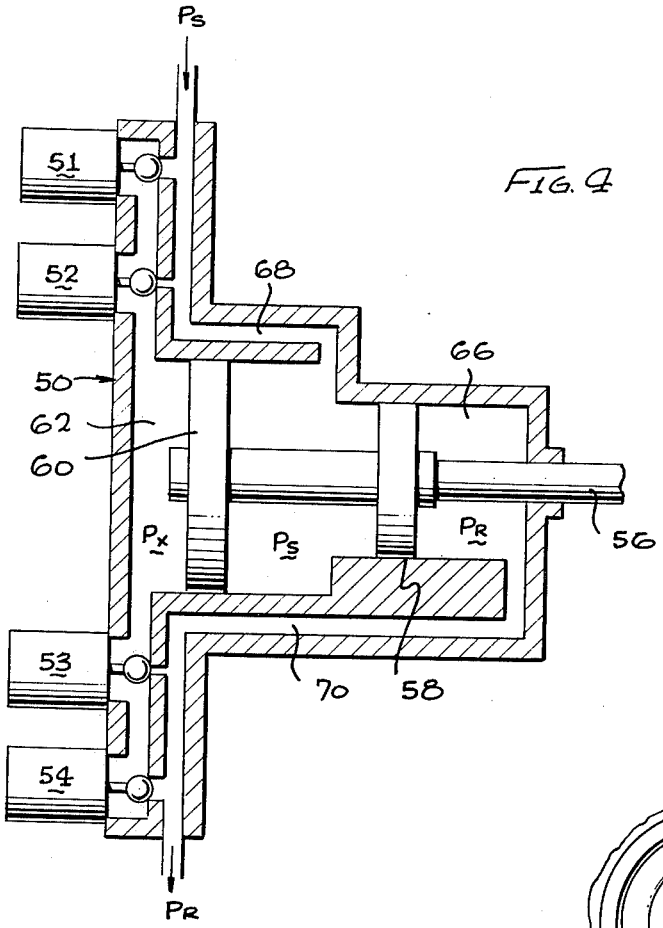
FIG. 4 is a schematic drawing of an additional embodiment of my invention.

Referring now to FIG. 1, one embodiment of my actuator is shown having a housing incorporating a pair of coaxial cylindrical bores 12 and 14 of unequal diameter. Positioned in bores 12 and 14 on a common shaft 16, which may be connected to a desired device to be actuated, are a pair of pistons 18 and 20. For use in a gas turbine fuel control, the smaller diameter piston 18 may cooperate with orifices in housing 10 to define the fuel metering area, the operating fluid then being fuel. Pistons 18 and 20 in association with the bores 12 and 14 define three control pressure chambers 22, 24 and 26. Chamber 24 communicates through a passage 28 in housing 10 with a source of hydraulic fluid or fuel under substantial pressure $P_s$. Chamber 26 communicates through a passageway 30 with the return side of the fluid pressure source $P_r$ or with a sump. Chamber 22 is a control pressure chamber $P_x$ whose pressure is varied through the action of a first normally closed solenoid valve 32 which communicates with the high pressure source in passageway 28 and with a second normally closed solenoid valve 34 which communicates with a passageway 30 leading to the return pressue source. The areas of pistons 18 and 20 are controlled such that at equilibrium the control pressure $P_x$ is intermediate between the supply pressure $P_s$ and the return pressure $P_r$. Opening of solenoid valve 32 meters high pressure fluid into the chamber 22, thereby causing the piston to move to the right and to stop when the valve closes. Similarly, opening of solenoid valve 34 meters fluid flow out of the chamber 22 to return, causing the piston to move to the left and to stop again when the valve closes. The smallest discrete movements will occur for the shortest actuation period for solenoid valves 32 and 34. It will be recognized that with the arrangement shown in FIG. 1, loss of power to the solenoid valves 32 and 34 will result in pistons 18 and 20 and shaft 16 being hydraulically locked in the last position which they assumed before the loss of power.

For some applications, it is preferred that the actuator slowly drift to a preselected position. An arrangement for accomplishing this is shown in FIG. 2 which shows a modification of the structure of FIG. 1 including a valve shaft 16′ carrying a first piston 18′ and a second piston 20′, all of which are reciprocal within a housing 10′. Shaft 16′ includes a hollow section over a stationary valve member 36 attached to the wall of housing 10′, thereby defining an interior chamber 38. In the side wall of the hollow section of valve shaft 16′ is a first small orifice 40 communicating with return pressure chamber 26′ and a second small orifice 42 which communicates with the supply pressure chamber 24′. Stationary valve member 36 has a reduced diameter portion which extends within the interior of movable valve shaft 16′ and cooperates therewith to define a generally annular passageway 44 communicating with a port 46 leading to an axial conduit 48 connected to the chamber 38 in the hollow interior of the movable valve shaft 16′. In the event of a power failure, the normally closed solenoids are held closed and supply pressure connected to the chamber 24′ will cause fluid to flow through orifice 42 if the valve shaft 16′ is to the left of the position shown. Fluid at supply pressure flowing past orifice 42 will also pass through annular passageway 44 into the control chamber 22′ thereby increasing $P_x$ and causing the piston 20′ to move toward the right until flow through orifice 42 is blocked by the larger diameter portion of stationary valve shaft 36. Should the movable valve shaft 16′ be positioned somewhat to the right of that shown, the control pressure chamber 22′ will be in communication with annular chamber 44, port 46, passageway 48, chamber 38, orifice 40, and with the return pressure chamber 26′, and this will cause control pressure $P_x$ to be reduced, thereby permitting supply pressure in chamber 24′ to force piston 20′ to the left until the passageway 40 is covered by the larger diameter portion of stationary valve member 36. From the foregoing it will be recognized that, irrespective of what position the valve shaft 16′ occupies at the time of a power failure, it will drift at a rate controlled by the areas of ports 40 and 42 until it reaches a position where both of ports 40 and 42 are effectively blocked by the large diameter portion of stationary valve member 36, after which it will remain locked in this position. For normal operation, a slow limit cycle results just as in the case of the FIG. 1 device wherein periodic short openings of solenoid valve 32 correct for positions of the output shaft to the left of the desired position, and periodic short openings of solenoid valve 34 correct for output shaft positions to the right of the desired position.

A modification of the embodiment of FIG. 2 is shown in FIG. 3. In this modification, a normally open solenoid valve 37 fastened to the housing 39 remains energized and prevents the above described limit cycling so long as it is connected to an electrical power source. When electrical power fails and/or any other emergency is signaled by turning off the power to this solenoid, it opens, connecting a stationary valve member 41 having an axial bore 43, a radial bore 45, and a restricted radial bore 47 with the control pressure $P_x$ in chamber 49. Supply pressure $P_s$ is connected through a conduit 55 to a chamber 57 on the opposite side of a large diameter piston 59 from chamber 49 and is also connected through a bore 61 with a chamber 63 on the inside of piston shaft 65. A pair of normally closed solenoid valves 67 and 69 control communication between the supply pressure source 55 and the control pressure chamber 49 and between the control pressure chamber 49 and a return pressure $P_r$ line 71, respectively, essentially as described above. Return pressure line 71 also communicates with a return pressure chamber 73 and with a passageway 75 which at times communicates with radial bore 45.

When the piston 59 is to the left of the position shown and the normally open solenoid valve 37 is open, supply pressure $P_s$ will flow from chamber 57 through bore 61, chamber 63, bores 45, 43 and 47, and into control pressure chamber 49 to cause piston 59 to move to the right to return to the position shown. Similarly, for positions of piston 59 to the right of that shown, flow will exhaust from the control pressure chamber 49 through bores 47, 43 and 45 into passage 75 and into the return pressure chamber 73. This allows supply pressure to move the piston 59, and hence bore 45, back left to the position shown where bore 45 is blocked. Thus shaft 65 is hydraulically locked in the preferred failed position when solenoid valve 37 is open, but when it is closed normal limit cycling occurs, as discussed above.

With the arrangement shown in FIG. 4, operation is essentially as described above with respect to FIG. 1 except that greater flexibility is afforded through the use of solenoid-operated valves of different sizes. Thus, with respect to valves 51 and 52 which communicate with supply pressure in conduit 68 when a given pulse is provided to solenoid valve 51, the flow into control pressure chamber 62 is much greater than when an identical pulse is supplied to solenoid valve 52 because of the difference in effective areas of the valves. Similarly, when a given pulse is supplied to one of valves 53 and 54 which communicate with return pressure from chamber 66 in a conduit 70, flow through the orifice controlled by valve 54 will be greater than that through valve 53, so small increments of flow can be provided by means of a pulse to solenoid valve 53. When rapid slew rates are required, long pulses can be supplied to valve 51 or valve 54, or even to both of valves 51 and 52 or valves 53 and 54, at the same time. For very small adjustments of the pistons 58 and 60, only the smaller solenoid valves 52 and 53 may be energized. It will be recognized that where pulse width and amplitude are at the minimum possible consistent with the response time of the solenoid, the larger opening may still permit too great a flow, thereby administering too large a dose and too great a movement of shaft 56. The smaller opening can then provide the proper flow and allow the required small movement. In this way the two-valve arrangement can provide the needed performance with solenoids of normal response characteristics which would otherwise require a special high response speed to achieve the needed small travel increments for good control.

Figure 6:
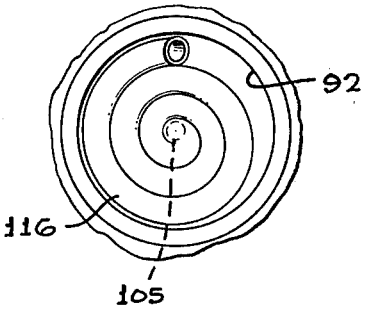
FIG. 6 is a projected view of a portion of the structure of FIG. 4.
Figure 5:
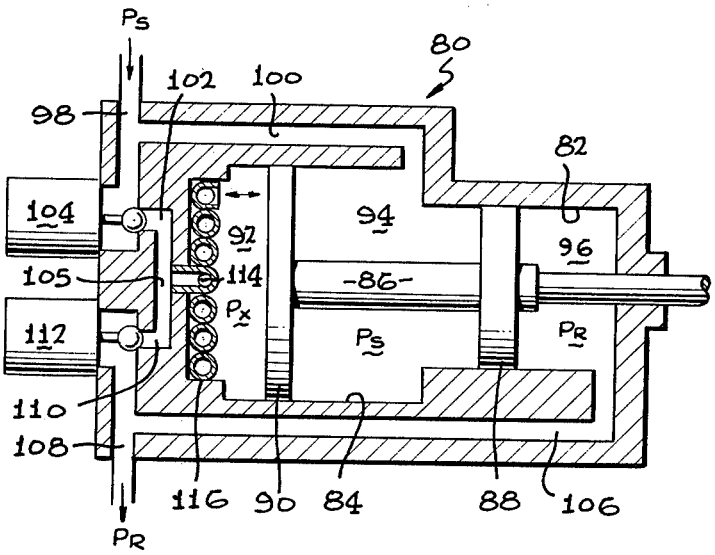
FIG. 5 is a schematic drawing of a further embodiment of my invention.
Figure 7A:
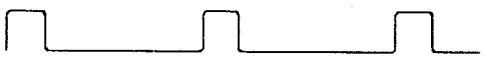
FIGS. 7*a* and 7*b* are graphs depicting typical solenoid travels as a function of time in response to pulses from an electronic controller for the embodiment of FIGS. 5 and 6.
Figure 7B:
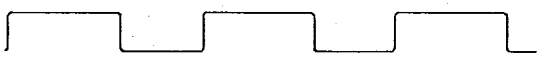
Figure 7C:
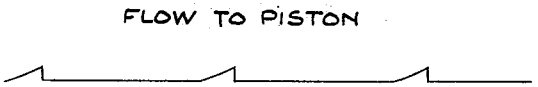
FIGS. 7*c* and 7*d* are graphs depicting hydraulic fluid flow to the piston resulting from the solenoid travels of FIGS. 6*a* and 6*b* respectively.
Figure 7D:
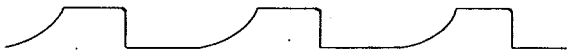
Figure 7E:
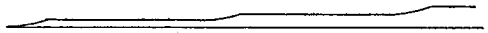
FIGS. 7*e* and 7*f* are graphs showing piston travel resulting from the hydraulic flows of FIGS. 7*c* and 7*d*, respectively.
Figure 7F:
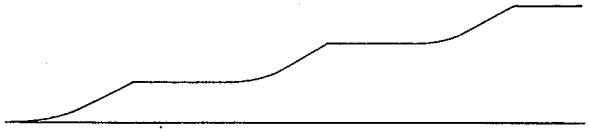

Another way of dealing with the problem of providing very small flows with solenoid valves of normal response speed and precision appears in the embodiment shown in FIGS. 5 and 6. In this embodiment a housing 80 encloses a smaller diameter bore 82 and an axially displaced, but concentric, larger diameter bore 84. Carried on a common shaft 86 are pistons 88 and 90 which cooperate with the walls of bores 82 and 84 to define a control pressure $P_x$ chamber 92, a supply pressure $P_s$ chamber 94 and a return pressure $P_r$ chamber 96. The working fluid such as hydraulic oil or fuel is supplied at a high pressure to an inlet port 98 communicating with a passageway 100 leading to chamber 94. Port 98 also communicates with a port 102 which is controlled by means of a solenoid-operated valve 104 and which controls flow into chamber 105 from the high pressure fluid source. Similarly return fluid pressure is communicated from chamber 96 through a passageway 106 to an outlet port 108. Port 108 also communicates with a port 110 controlled by a solenoid valve 112 controlling communication between chamber 105 and the return side of the supply source or other low pressure source.

Chamber 105 connects with a port 114 which serves as the opening to a sprially wound small diameter tube 116 (shown in projected view in FIG. 6) having an opening into control pressure chamber 92. The diameter and effective length of tube 116 are chosen such that upon acceleration of the fluid contained in it a substantial amount of inertial resistance is imposed to the flow of fluid therethrough. Operation of the FIG. 5, 6 structure is depicted in the graphs, FIGS. *7a* through *7f*. FIG. *7a* indicates comparatively short and widely spaced voltage pulses supplied to solenoid valve 104. Because of the inertial resistance to flow imposed by the length of tube 116, the flow to the piston does not follow the pattern of FIG. *7a*, but increases as a series of small, slowly rising increments as shown in FIG. *7c*. This pattern results in piston travel as shown in FIG. *7e* where each pulse to the solenoid valve 104 results in a very small translation of the pistons 88, 90 as indicated by the height of the curve above its initial point of departure.

In FIG. *7b* is depicted a series of comparatively long signal pulses to the solenoid valve 104. These pulses give rise to flows into the control pressure chamber 92 as shown in FIG. *7d*. The flow pattern of FIG. *7d* indicates a slow building up of the flow to the maximum level permitted by the opening of solenoid valve 104 because of the inertial resistance imposed by tube 116, after which the flow continues at the maximum level until the electrical pulse is terminated. This longer flow gives rise to travel of pistons 88, 90 as indicated by curve *7f* wherein the translation of said pistons is substantial but lag somewhat the electrical pulse signals *7b*. It will be noted that the piston travel stops with the termination of each pulse of *7b*, and that the proportionate effect of the inertial resistance of tube 116 becomes much less for comparatively long signal pulses to the solenoid valves.

It will be recognized that the above described embodiments of my invention are applicable to determining the axial position of an output shaft for any of many purposes, such as for metering fuel to an engine, for controlling the position of inlet guide vanes to a compressor, for controlling the position of control surfaces, etc. For any of the above embodiments, the capability of determining the position which will be retained in the event of an electrical failure is quite advantageous whether that position be the last controlled position or a predetermined position. The above described actuators are uniquely applicable to digitally controlled systems since the signals supplied to the solenoid-operated valves are digital.

What is claimed is:

1. An electrohydraulic doser actuator comprising a housing having a bore therewithin;

piston means contained by said bore and axially movable therein, said piston means having at least one hydraulic fluid pressure-responsive surface area, said surface area defining a variable volume hydraulic fluid control chamber in a portion of said bore;

means for exerting a constant force upon said piston means in a direction which causes said piston means to axially move to reduce the volume of said control chamber;

valve means operatively connected to said control chamber for selectively venting a quantity (dose) of pressurized hydraulic fluid either to or from said control chamber thereby axially moving said piston means in opposite directions within said bore to either increase or reduce respectively said volume of said control chamber;

control means for controlling said valve means to vary said quantity (dose) of said hydraulic fluid vented to or from said control chamber thereby effecting axial movement of said piston means to desired axial positions;

said valve means including a first valve to vent said fluid quantity (dose) to said control chamber and a second valve to vent said fluid quantity (dose) from said control chamber, said valves having only on-off operational states, being either fully open or fully closed, respectively, whereby said quantity (dose) of hydraulic fluid depends, in part, on the amount of time said orifices are in said on state, each of said first and second valves having a normally closed position thereby establishing in said position a hydraulic lock on said piston means thereby maintaining said last desired axial position.

2. An electrohydraulic doser actuator as claimed in claim 1 wherein:

said piston means further includes differential opposing hydraulic fluid pressure-responsive surface areas, one said surface area defining said control chamber; and said constant force means includes means to continuously vent pressurized hydraulic fluid to another portion of said bore for acting upon at least one other said surface area.

3. An electrohydraulic doser actuator as claimed in claim 1 wherein said operative connection between said valve means includes an elongated passageway imposing substantial inertial resistance to fluid flow between said valve means and said control chamber.

4. An electrohydraulic doser actuator as claimed in claim 1 further including: positioning means for slowly restoring said piston means from said desired axial positions to a predetermined axial position and thereafter maintaining said predetermined axial position.

5. An electrohydraulic doser actuator as claimed in claim 4 wherein said positioning means further includes: a plurality of fluid bleed orifices in said piston means; and a valve member secured to said housing, said valve member cooperating with said bleed orifices to slowly vent hydraulic fluid to or from said control chamber when said piston means is at an axial position other than said predetermined axial position to axially move said piston means to said predetermined axial position.

6. An electrohydraulic doser actuator as claimed in claim 2 wherein: said bore has first and second ends; and said piston means includes first and second fluid pressure-responsive piston members, each said piston member having opposing fluid pressure-responsive surface areas, said opposing fluid pressure-responsive surface areas of said first piston member being greater than said surface areas of said second piston member, said piston members secured together in an axially spaced relationship within said bore and thereby defining first, second and third variable volume chambers, said first chamber being defined between said first end and said first piston member, said second chamber being defined between said second end and said second piston member, said third chamber being defined between said first and second piston members.

7. An electrohydraulic doser actuator as claimed in claim 6 wherein: said first chamber is said control chamber and said continuously vented pressurized hydraulic fluid is vented to said third chamber.

8. An electrohydraulic doser actuator as claimed in claim 6 further including: third and fourth on-off, normally closed valves for venting said fluid (quantity) to and from said control chamber respectively, said first and second valves respectively thereby venting a larger quantity of hydraulic fluid to or from said control chamber for a same period of time in said on state than said third and fourth valves, respectively.

9. An electrohydraulic doser actuator as claimed in claim 3 wherein said elongated passageway comprises a tightly wound spiral of small diameter tubing.

10. An electrohydraulic doser actuator as claimed in claim 8 further including: positioning means for slowly restoring said piston means from said desired axial position to a predetermined axial position and thereafter maintaining said predetermined axial position.

11. An electrohydraulic doser actuator as claimed in claim 10 wherein: said positioning means further includes a plurality of fluid bleed orifices in said piston means; and a valve land member secured to said housing, said valve member cooperating with said bleed orifices to slowly vent hydraulic fluid to or from said control chamber when said piston means is at an axial position other than said predetermined axial position in order to axially move said piston means to said predetermined axial position.

12. An electrohydraulic doser actuator as claimed in claim 7 wherein: a second source of pressurized hydraulic fluid is continuously vented to said third chamber, said second source being at a lower pressure relative to said first source, said second source also being less than or equal to a hydraulic pressure developed in said control chamber; and said first orifice valve communicates said control chamber to said first source of pressurized hydraulic fluid; and said second orifice valve communicates said control chamber to said second source of pressurized hydraulic fluid.

13. An electrohydraulic doser actuator as claimed in claim 8 including: an output member secured to one of said piston members and passing through one of said ends for transmitting said axial position of said piston members to a device to be actuated.

14. An electrohydraulic doser actuator as claimed in claim 13 further including: positioning means for slowly restoring said piston means from said desired axial position to a predetermined axial position and thereafter maintaining said predetermined axial position.

15. An electrohydraulic doser actuator as claimed in claim 14 wherein said positioning means further includes: a plurality of fluid bleed orifices in said piston means; and a valve land member secured to said housing, said land member cooperating with said bleed orifices to slowly vent hydraulic fluid to or from said control chamber when said piston means is at an axial position other than said predetermined axial position in order to axially move said piston means to said predetermined axial position.

16. An electrohydraulic doser actuator as claimed in claim 13 wherein: said first chamber is said control chamber, said continuously vented pressurized hydraulic fluid is vented to said second chamber.

17. An electrohydraulic doser actuator as claimed in claim 6 wherein said first chamber is said control chamber and said continuously vented pressurized hydraulic fluid is vented to said second chamber.

18. An electrohydraulic doser actuator as claimed in claim 17 further including: third and fourth on-off, normally closed, orifice valves for venting said fluid dose to and from said control chamber, respectively, said third and fourth valves having larger sized orifices than said first and second valves, respectively, thereby venting a larger dose of hydraulic fluid to or from said control chamber for a same period of time in said on state than said first and second valves respectively.

19. An electrohydraulic doser actuator as claimed in claim 18 wherein: a second source of pressurized hydraulic fluid is continuously vented to said third chamber, said second source being at a lower pressure relative to said first source and said second source also being less than or equal to a hydraulic pressure developed in said control chamber; and said first and third orifice valves communicate said control chamber with said first source pressurized hydraulic fluid; and said second and fourth orifice valves communicate said control chamber with said second source of pressurized hydraulic fluid.

* * * * *